US008079095B2

(12) United States Patent
Jensen

(10) Patent No.: US 8,079,095 B2
(45) Date of Patent: Dec. 20, 2011

(54) LIMITED VOLUME HIGH PERFORMANCE FLUSH VALVE ASSEMBLY

(75) Inventor: Robert M. Jensen, East Brunswick, NJ (US)

(73) Assignee: Ideal Standard International BVBA (BE)

( * ) Notice: Subject to any disclaimer, the term of this patent is extended or adjusted under 35 U.S.C. 154(b) by 1144 days.

(21) Appl. No.: 11/832,492

(22) Filed: Aug. 1, 2007

(65) Prior Publication Data

US 2008/0052812 A1 Mar. 6, 2008

Related U.S. Application Data

(60) Provisional application No. 60/842,203, filed on Aug. 31, 2006.

(51) Int. Cl.
*E03D 1/35* (2006.01)

(52) U.S. Cl. ..... 4/399; 4/397

(58) Field of Classification Search ..... 4/395, 397, 4/399

See application file for complete search history.

(56) References Cited

U.S. PATENT DOCUMENTS

| | | | | |
|---|---|---|---|---|
| 1,895,786 | A | 1/1933 | Cobb | |
| 2,632,895 | A | 3/1953 | Teahen | |
| 2,904,794 | A * | 9/1959 | Goldtrap | 4/400 |
| 3,108,287 | A * | 10/1963 | Stallworth | 4/399 |
| 4,841,579 | A | 6/1989 | Antunez | |
| 5,926,861 | A | 7/1999 | Frost | |
| 6,715,162 | B2 | 4/2004 | Han et al. | |
| 6,728,975 | B2 | 5/2004 | Han | |
| 6,901,610 | B1 | 6/2005 | Jensen et al. | |
| 6,910,232 | B2 | 6/2005 | Antunez | |

* cited by examiner

*Primary Examiner* — Huyen Le
(74) *Attorney, Agent, or Firm* — Baker & McKenzie LLP

(57) ABSTRACT

A flush valve assembly of the present invention includes a body subassembly in operable communication with a movable poppet seal subassembly via a guide rod of a predetermined length. The body subassembly inlet is substantially located above the tank floor, thereby reducing available tank discharge volume. The poppet subassembly includes a float having upper and lower float covers with an annular seal disposed therebetween. The poppet subassembly remains coaxially and slidably mounted with respect to the body subassembly so as to create a valve opening therebetween when the poppet subassembly is removed from its initial closed position to a second open position. Guide structure in the body subassembly accommodates reciprocatable movement of the guide rod and inhibits deviation of the guide rod from a predetermined axial guide path when the poppet subassembly is in use during a flush cycle. An optional valve bracket may be provided.

18 Claims, 6 Drawing Sheets

LIMITED VOLUME HIGH PERFORMANCE FLUSH VALVE ASSEMBLY

This application claims the benefit of the filing date of U.S. Ser. No. 60/842,203, filed on Aug. 31, 2006, and the disclosure of which is incorporated by reference in its entirety.

FIELD OF THE INVENTION

The present invention is directed to a flush valve assembly for use in a water tank of a toilet. More particularly, the present invention is directed to a flush valve assembly with enhanced energy throughput provided via a single moving part. The valve assembly of the present invention provides a full, unobstructed flow path (thereby maximizing energy throughput) and also includes structure that limits tank discharge to less than 2 gallons. In this configuration, the present invention ensures compliance with applicable water conservation legislation with no attenuation of flushing performance.

BACKGROUND OF THE INVENTION

Toilets for removing waste products are well known. Typically, toilets incorporate three systems that work together to perform the flushing action: the bowl siphon, the flush mechanism and the refill mechanism. Working in concert, these three systems allow the flushing function of the toilet. Usually, the tank, positioned over the back of the bowl, contains water that is used to initiate the siphoning from the bowl to the sewage line, after which fresh water refills the bowl. When a user desires to flush the toilet, the user depresses the flush lever on the outside of the tank, which is connected on the inside of the tank to a movable chain or lever. Upon depression, the flush lever moves a chain or lever on the inside of the tank, thereby lifting and opening the flush valve and to cause water to flow from the tank and into the bowl initiate the toilet flush.

In many toilet designs, water flows directly into the bowl and disperses into the rim of the toilet bowl. The water releases into the bowl rather quickly, with flow from the tank into the bowl typically lasting approximately 2 to 4 seconds. The water flows from the rim, down a channel within the sides of the bowl and into the large hole at the bottom of the toilet (commonly known as a siphon jet). The siphon jet releases most of the water into an adjoining siphon tube, thereby initiating the siphon action. The siphoning action draws all of the water and waste out of the bowl and into the siphon tube. The waste and water continues through the other end of the siphon tube through an area known as the trapway and is then released into the wastewater line connected at the base of the toilet. Once the tank is emptied of its contents during the flush, the flush valve closes, and a floating mechanism which has now dropped in the tank to some residual amount initiates the opening of the filler valve. The filler valve provides fresh water to both the tank and the bowl through separate flows. Eventually the tank fills with water to a high enough level to cause the float to rise, thus shutting off the filler valve. At this point, the flushing cycle is complete.

The excessive consumption of potable water, however, remains a dilemma for water agencies, commercial building owners, homeowners, residents and sanitaryware manufacturers. An increasing global population has negatively affected the amount and quality of suitable water. In response to this global dilemma, many local and federal authorities have enacted regulations that reduce the water demand required by toilet flushing operations. In the United States, for instance, government agencies that regulate water usage have gradually reduced the threshold for fresh water use in toilets, from 7 gallons/flush (prior to the 1950s) to 5.5 gallons/flush (by the end of the 1960s) to 3.5 gallons/flush (in the 1980s). The National Energy Policy Act of 1995 now mandates that toilets sold in the United States can only use 1.6 gallons/flush (6 liters/flush).

In the crowded art of producing a more reliable, more efficient and more powerful 1.6 gallon (6 liter) gravity toilet, the present inventor has overcome detriments in toilet technology by increasing the hydraulic energy available during the flushing operation (see U.S. Pat. No. 6,901,610 for HIGH PERFORMANCE VALVE ASSEMBLY FOR TOILETS, U.S. Pat. No. 6,728,975 for HIGH PERFORMANCE FLUSH VALVE ASSEMBLY and U.S. Pat. No. 6,715,162 for TOILET ASSEMBLY, all of which are co-owned by the owner of the present application and the entire disclosures of which are hereby incorporated by reference). These patents disclose a flush valve assembly for a water tank of a toilet that includes a valve body secured thereto. The valve body has a base sleeve portion including a radiused inlet to increase the discharge coefficient of the valve opening. A flush cover member is coaxially and slidably mounted with respect to the valve body so that the valve opening is created therebetween when the flush cover member is removed form the valve body via reciprocating motion. The flush cover member is slidably movable between a first position, wherein the flush cover member is seated on the base sleeve portion of the valve body and thereby obstructs water flow through the valve opening, and a second position, wherein the second valve member is removed from the base sleeve portion of the valve body to permit water flow through the valve opening. A sealing member is provided to ensure a proper seal when the flush cover member is in the first position, and a guiding means is provided that properly aligns and guides the flush valve cover relative to the valve body. The flush valve assembly also includes a trip release mechanism that releases the effects of the flush lever on the flush cover member when the flush cover member reaches its second position, thereby returning the flush cover member to its first rest position prior to the flush lever returning to its own corresponding rest position. In this configuration, the disclosed flush valve assembly ensures compliance with the mandated water requirements and simultaneously provides enhanced cleanliness and waste removal capabilities. The flush valve assembly achieves these functions and also releases the effect of the flush lever so that the valve opening can close before the expiration of a regulatory minimum "hold down" time (1 second without exceeding the total water per flush mandate of 1.6 gallons (6 liters)).

Although Applicant's prior solutions effectively remove waste from toilet bowls within government guidelines, such guidelines no longer mandate a minimum "hold down time". It is therefore desirable to provide the aforementioned benefits in a flush valve assembly having minimal moving parts for ease of manufacturing, installation, operation and maintenance. Such advantage should be incorporated in the flush valve assembly without compromising the water conservation benefits of the prior flush solutions.

SUMMARY OF THE INVENTION

It is an advantage of the present invention to provide a flush valve assembly that overcomes the deficiencies of conventional flush valve assemblies.

It is also an advantage of the present invention to provide a flush valve assembly having optimal energy throughout of the flush water in comparison to existing flush valve assemblies to thereby provide more available energy for waste removal from the toilet bowl.

It is another advantage of the present invention to provide a flush valve assembly having all of the aforementioned benefits in combination with a minimum of moving parts.

In accordance with these and other advantages, the present invention provides a flush valve assembly for a water tank of a toilet having only one moving part. The flush valve assembly of the present invention includes a body subassembly in operable communication with a movable poppet seal subassembly via a guide rod of a predetermined length. The body subassembly inlet is substantially located above the tank floor, thereby reducing available tank discharge volume.

The poppet subassembly includes a float having upper and lower float covers with an annular seal disposed therebetween. The poppet subassembly remains coaxially and slidably mounted with respect to the body subassembly so as to create a valve opening therebetween when the poppet subassembly is removed from its initial closed position to a second open position. Proper guidance and alignment of the poppet subassembly is effected by the guide rod, which is secured to either or both of the upper and lower float covers. Guide structure in the body subassembly accommodates reciprocatable movement of the guide rod and inhibits deviation of the guide rod from a predetermined axial guide path when the poppet subassembly is in use during a flush cycle.

An optional valve bracket may be provided which includes an aperture for seating of the body subassembly therein and at least one protuberance that accommodates insertion of at least a portion of a corresponding fastener (such as a thumb screw or mounting bolt). This bracket serves as a means for inhibiting rotation of the fastener upon tightening of a corresponding fastener nut.

The flush valve assembly of the present invention features coaxial poppet seal and body subassemblies, thereby reducing the valve to a single moving part without compromising valve performance. The valve operates similar to a flapper for reliable and predictable operation, yet a high fluid flow rate is achieved by maximum orifice flow characteristics. The present invention flush valve assembly assumes alternative embodiments for use in both one-piece and two-piece toilet configurations.

Various other advantages and features of the present invention will become readily apparent from the ensuing detailed description and the novel feature will be particularly pointed out in the appended claims.

DETAILED DESCRIPTION OF THE PREFERRED EMBODIMENTS

Figure 4:
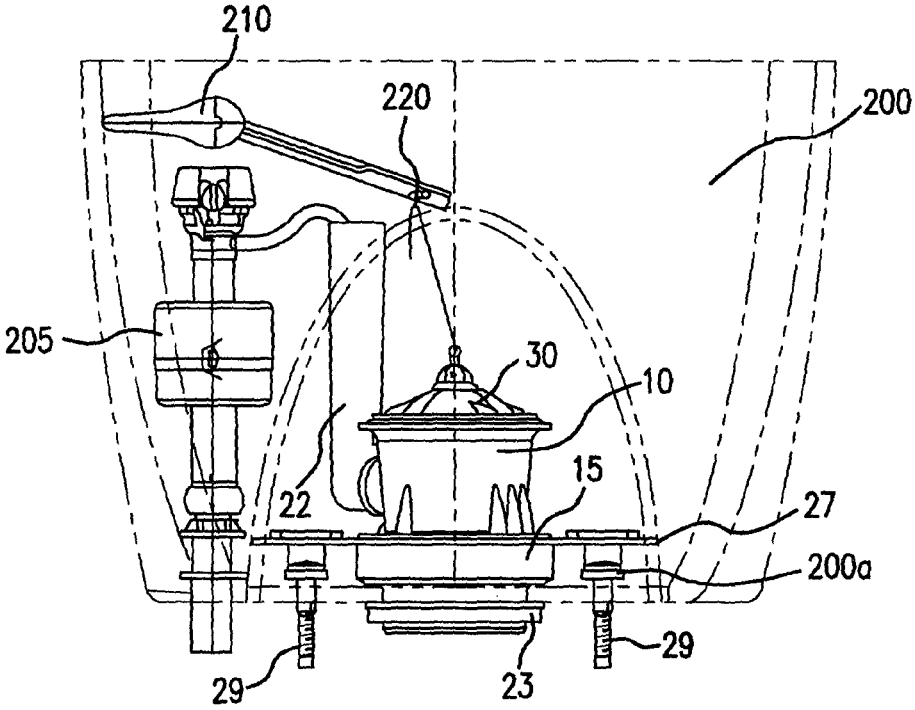
FIG. 4 shows the flush valve assembly of FIG. 1 installed in a toilet tank.

As illustrated in the figures, wherein like numbers identify like elements, flush valve assembly 10 of the present invention is disposed in a tank 200 of a toilet assembly (shown in FIG. 4) wherein the tank stores water for delivery to a bowl in fluid communication therewith. Flush valve assembly 10 is operable with a conventional fill valve 205 that may be selected from any known fill valve that is amenable to successful practice of the present invention. Flush valve assembly 10 is operable upon actuation of an actuation means such as trip lever 210 as is further described hereinbelow.

Valve assembly 10 includes body subassembly 12 in operable communication with a movable poppet seal subassembly 14 via a guide rod 16 of a predetermined length. Body subassembly 12 includes a valve body 12*a* with a proximate extent 12*a*' having a radiused inlet 13, a distal extent 12*a*" having an elevated base 15, and a coextensive wall 12*b* therebetween (radiused inlet 13 desirably has an outer diameter $OD_{inlet}$ of about 5"). Wall 12*b* is generally circumferential and has an outer peripheral surface 12*b*' from which a connection member 19 protrudes generally normally and an inner peripheral surface 12*b*" that defines a region 20 through which flush water travels during a flush cycle. Connection member 19 is shown in the form of an annular extension having a distal extent 19*a* at which an opening is defined for accommodation of an overflow tube 22 of predetermined length L and a proximate extent 19*b* adjacent outer peripheral surface 12*b*'. A second opening is defined at proximate extent 19*b* of connection member 19 so as to establish fluid communication between the toilet tank and valve region 20 via overflow tube 22 as is known in the art.

At valve body distal extent 12*a*", an annular fluid outlet 13*a* is provided that establishes fluid communication between valve body 12 and a toilet bowl (fluid outlet 13*a* desirably has an inner diameter $D_{outlet}$ from about 3.0" to about 3.5" such that flush valve assembly 10 can be employed in a plurality of commercial toilet embodiments). Intermediate fluid outlet 13*a* and valve body wall 12*b* is an elevated base 15, shown as a generally annular member that elevates valve body 12*a* relative to a bottom surface 200*a* of toilet tank 200. A threaded portion 15*a* defined along at least a portion of elevated base 15 enables securement of valve assembly 10 to the tank and bowl via a plurality of threads and a corresponding fastening member (such as nut 23 and gasket 25 shown herein). It is understood that the threaded securement means shown herein are merely illustrative and do not limit the types of securement means that may be employed with the present invention.

Figure 1:
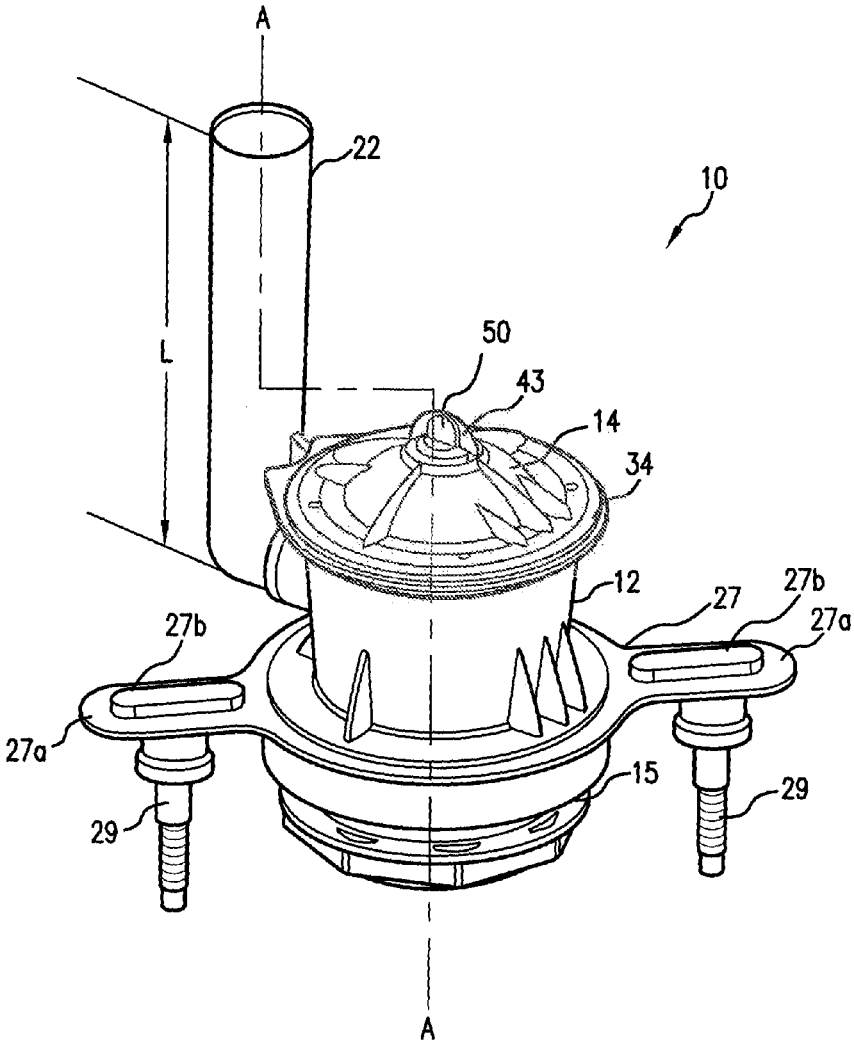
FIG. 1 shows a front perspective view of a flush valve assembly according to the present invention in combination with a valve bracket.

Additional securement of flush valve assembly 10 in a toilet assembly is effected by an optional valve bracket 27 having an aperture (not shown) that accommodates seating of base 15 thereon (see FIG. 1). Bracket 27 is selectively provided with at least one protuberance 27*a* having an aperture 27*b* defined therethrough that accommodates insertion of at least a portion of a corresponding fastener such as thumb screw 29 (although it is understood that other comparable fasteners may be used without departing from the scope of the present invention). As shown in FIG. 1, a bracket aperture 27*b* advantageously secures a portion of thumb screw 29 or comparable fastener thereby so as to prevent rotation of the fastener screw during assembly of the tank to the bowl.

Figure 2:
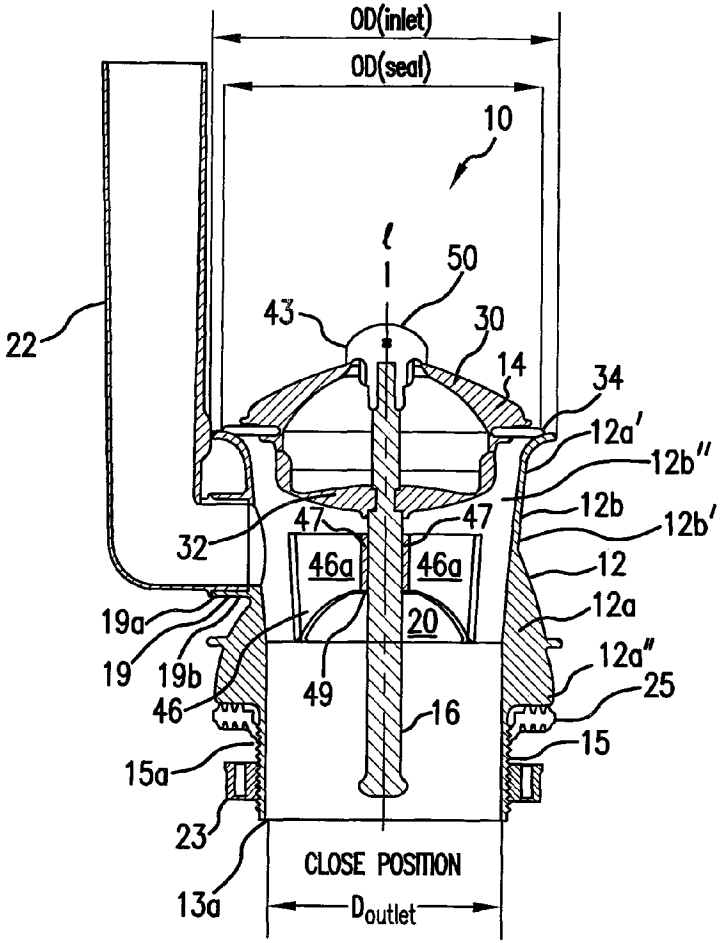
FIGS. 2 and 3 shows sectional views of the flush valve assembly of FIG. 1 taken along line A-A when the valve is in closed and open positions, respectively (the valve bracket has been omitted).
Figure 3:
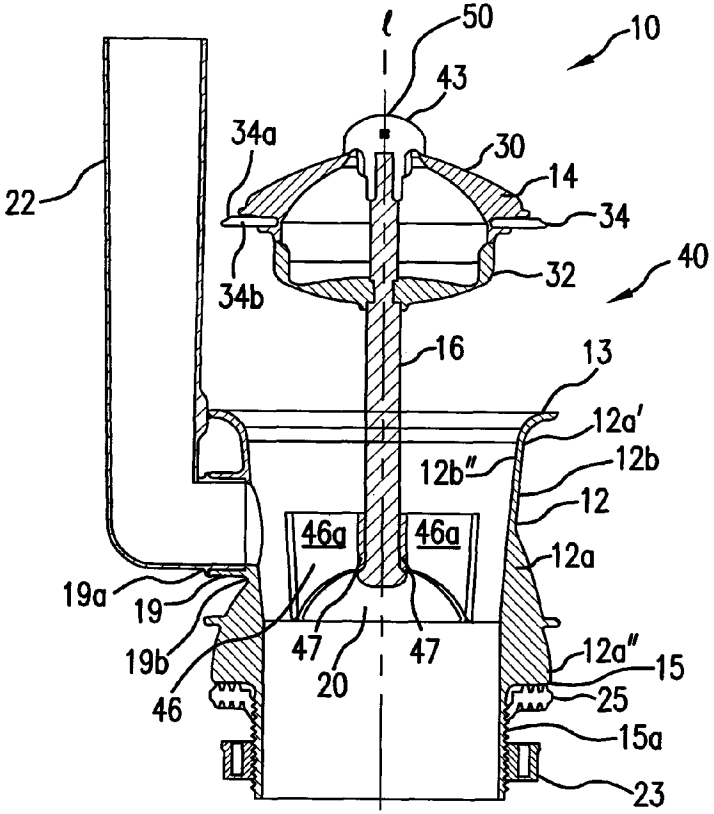

Poppet subassembly 14 includes an upper float cover 30 and a lower float cover 32 having an annular seal 34 disposed therebetween. Seal 34 has a top surface 34*a* and a bottom surface 34*b*, the latter of which is seated in sealing communication with inlet 13 when valve assembly 10 is in a first closed position (see FIG. 2). As described hereinbelow, poppet subassembly 14 remains coaxially and slidably mounted with respect to valve body 12*a* so as to create a valve opening 40 therebetween when poppet subassembly 14 is removed from its initial closed position adjacent inlet 13 to a second open position (see FIG. 3). Poppet subassembly 14 is slidably movable between a first rest position, wherein bottom seal surface 34*b* is seated relative to inlet 13 so that water cannot pass through valve opening 40, and a second position, wherein bottom seal surface 34*b* is elevated relative to inlet 13 to allow water to pass through valve opening 40. The second position comprises the end of the flush cycle, and thereby assumption of the second position determines the duration of the flush.

In order to properly guide and align poppet subassembly 14 with respect to valve body 12*a* when poppet subassembly 14 is moved between closed and open positions, poppet subassembly 14 includes guide rod 16 having a longitudinal axis defined therethrough, which axis is coincident with an axial flow path along which poppet subassembly 14 travels during operation of the flush valve. Guide rod 16 is secured to either or both of upper float cover 30 and bottom float cover 32, and securement is desirably effected by a plurality of threads that engage corresponding threads in a wing nut 43 (although it is understood that other types fastening means may be employed to effect such securement without departing from the scope of the present invention, including but not limited to frictional engagement, snap-fit engagement, a clutch configuration, epoxy and any combination and/or equivalent thereof). Tightening of wing nut 43 during engagement with guide rod 16 ensures fastened alignment of guide rod 16 relative to valve body 12*a* and more particularly relative to the guide structure defined therein (further described hereinbelow). In this manner, poppet subassembly 14 remains properly guided and accurately aligned with valve body 12*a* when the poppet subassembly is moved between its closed and open positions. This guiding structure (comprising guide rod 16 and the guide structure in valve body 12*a*) also ensures that annular seal 34 is properly seated adjacent inlet 13 to as to properly close and seal valve opening 40 in a predictable and repeatable manner.

The guide structure of valve body 12*a* is provided along inner peripheral surface 12*b*" of wall 12*b* as a spindle 46 or comparable member that limits movement of guide rod 16 thereby. Spindle 46 includes wings 46*a* extending from inner peripheral surface 12*b*" and having guide extents 47 that define a guide space 49 therebetween. Guide space 49 accommodates reciprocatable movement of guide rod 16 therethrough and desirably inhibits deviation of guide rod 16 from a predetermined axial guide path when flush valve assembly 10 is in use during a flush cycle. Such guide structure does not have any detrimental effect on the flow characteristics of flush water through valve body 12*a* during a flush cycle.

The diameter of annular seal 34 may be designed and/or selected so as to enable a force to be exerted on poppet subassembly 14 during a filling operation that is sufficient to force poppet subassembly 14 down and cause a proper seal to be formed. A desired range for annular seal diameter $OD_{seal}$ is from about 3.5" to about 4.3". Such force may be the minimum force necessary to pull poppet subassembly 14 downward and provide the proper seal. The flow characteristics of the flush water and the flow capacity of valve assembly 10 are enhanced by reducing the pulling force necessary to close and properly seal valve opening 40 when poppet subassembly 14 is moved from its second open position to its first closed position.

Figure 4A:
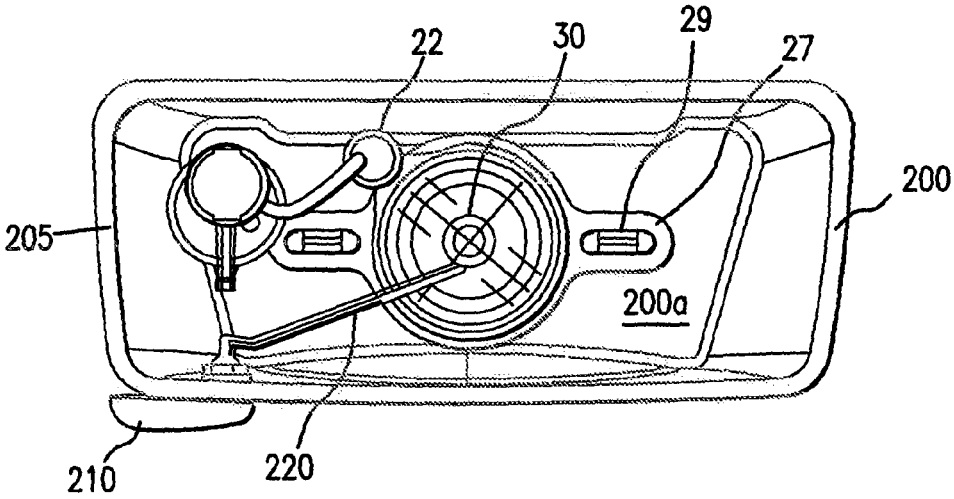
FIG. 4A shows a top view of the installation of FIG. 4.

When in the closed position, valve opening 40 is obstructed, thereby preventing the passage of flush water therethrough until actuation of flush valve assembly 10. A flush cycle begins upon activation of a trip lever 210 (shown in FIGS. 4 and 4A) or comparable actuation member having a first rest position and a second open position corresponding to movement of poppet subassembly 14 between its closed and open positions, respectively. The actuation member is connected to a lift attachment point 50 by conventional means (i.e., such as by chain and linkage assembly 220 shown in FIGS. 4 and 4A), wherein attachment point 50 is desirably provided either on wing nut 43 or integrated into upper float cover 30. Such placement ensures that, during elevation, poppet subassembly follows an axial travel path without any inclination relative to the axis of travel.

Upon elevation, buoyant forces and fluid pressure exerted on a bottom surface 34*b* of seal 34 prompts elevation of poppet subassembly 14 above inlet 13, thereby revealing valve opening 40. When the buoyant force exceeds the hydrodynamic fluid force (i.e., the water level in tank 200 is high and the fluid "suction" on poppet subassembly 14 is low prior to tank discharge), the poppet subassembly lifts above radiused inlet 13. In the open position, valve opening 40 allows flush water to flow therethrough and proceed into region 20 for subsequent delivery to passages within the toilet to which tank 200 is attached (as is known in the art). During traverse of the fluid flow path, guide rod 16 remains in alignment with guide space 49 to ensure an axial return path to the valve's closed position. Buoyant forces and fluid pressure in equilibrium at top seal surface 34*a* and bottom seal surface 34*b* keep poppet subassembly 14 elevated for a time sufficient to empty the contents of the tank and initiate refilling thereof (with filling effected by fill valve 205, shown in FIGS. 4 and 4A). As the tank volume discharges through valve opening 40, the water level in tank 200 decreases and poppet subassembly 14 consequently descends toward the radiused inlet 13. Increasing hydrodynamic forces acting upon poppet subassembly 14 therefore counteract the buoyant force to allow rapid descent of poppet subassembly 14 and decrease the fluid inlet area through valve opening 40 until the initial valve position is assumed. Upon contact of bottom seal surface 34*b* with inlet 13, there is no escape of fluid and the flush valve is ready for subsequent flush cycles.

Figure 6:
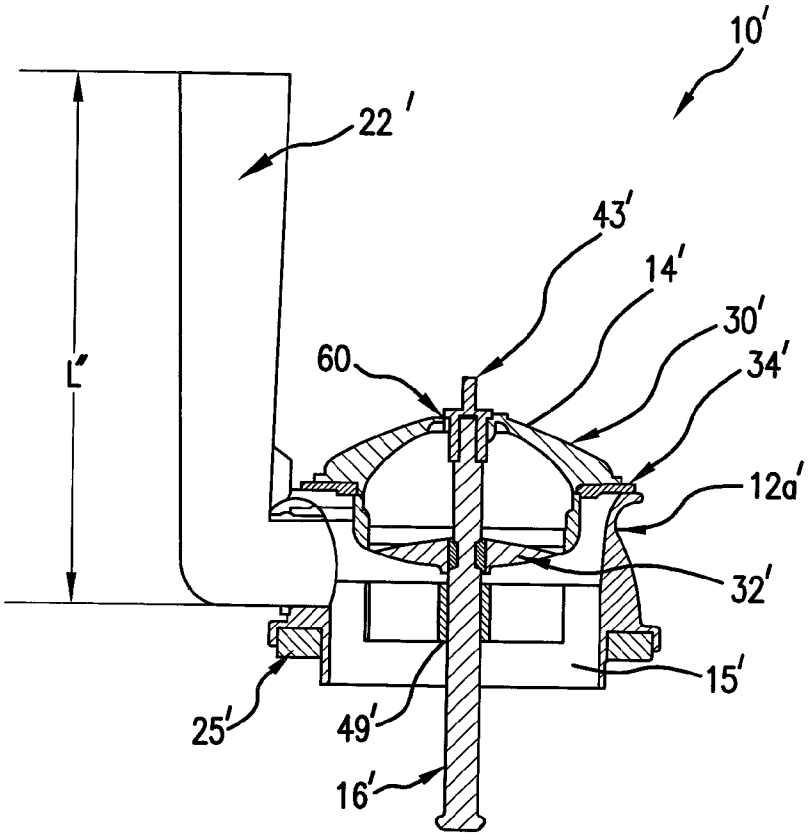
FIG. 6 shows a sectional view of the flush valve assembly of FIG. 4 taken along line B-B.
Figure 5:
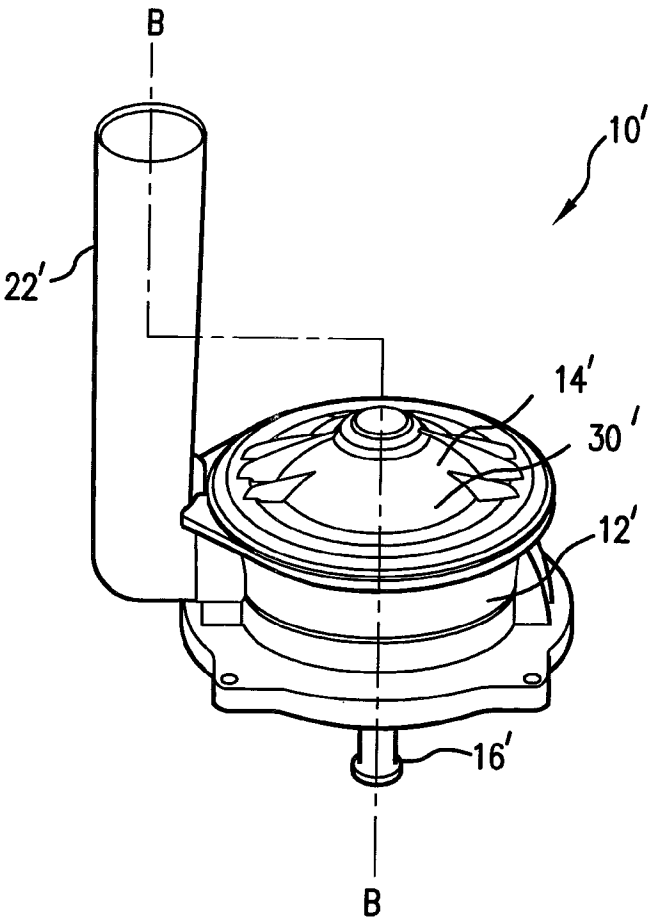
FIG. 5 shows a perspective view of an alternate embodiment of a flush valve assembly of the present invention.

Referring to FIGS. 5 and 6, an alternative embodiment of the present invention is provided that is envisioned for use with one-piece toilets (as are well-known in the art). Flush valve 10' has essentially the same elements as flush valve 10 envisioned for use with two-piece toilets. Flush valve 10' includes a poppet subassembly 14' comprising an upper float cover 30' and a lower float cover 32' with an annular seal 34' disposed therebetween. Poppet subassembly 14' is provided in combination with a body subassembly 12' having a valve body 12*a'* that is in fluid communication with a fluid overflow pipe 22' of predetermined length L' (which overflow pipe is anticipated to be interchangeable with overflow pipe 22 previously described). Valve body 12*a'* includes a base portion 15' that, although elevated, is shorter than base portion 15 provided in valve body 12*a* of the first embodiment (this is because flush assembly 10' is installed in a single-piece toilet and does not require securement to each of a tank and a bowl). Poppet subassembly 14' is guided by a guide rod 16' selectively secured via a wing-nut 43' having a sealing member such as O-ring 60 disposed thereadjacent. O-ring 60 beneficially replaces an outer gasket to reduce the amount of material required for manufacture and maintenance of the poppet subassembly. Guide rod 16' is guided through a guide space 49' in base portion 15' and operates substantially similarly to flush valve 10 described hereinabove. A sealing member such a valve gasket 25' is selectively provided upon installation of flush valve assembly 10'.

Figure 7:
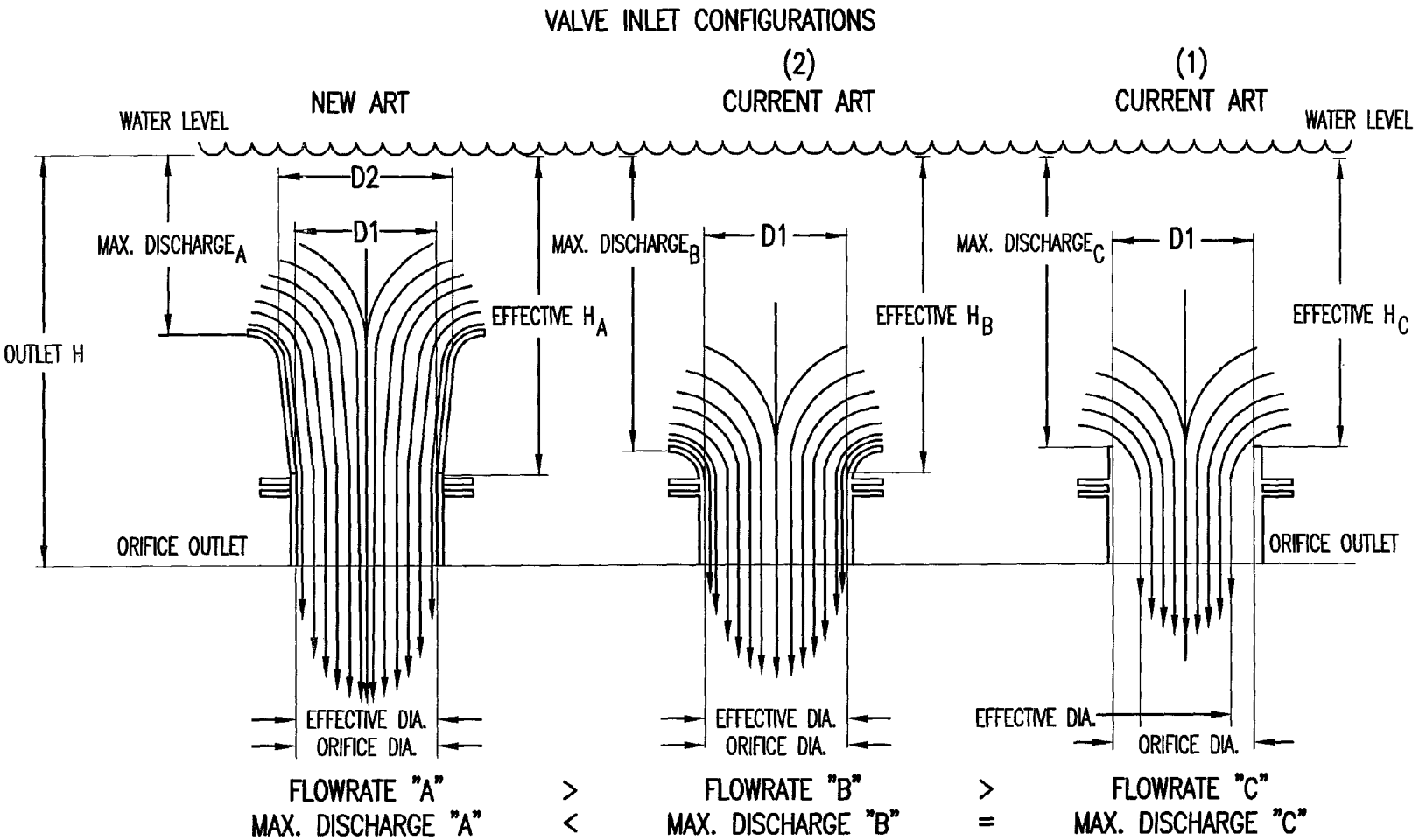
FIG. 7 shows the effect of the valve inlet configuration of the flush valve assembly of the present invention on maximum discharge at the effective head level. This effect is shown in comparison with the valve inlet configurations of two conventional flush valve assemblies.

It is noted that the elevated base raises an effective head level of each disclosed flush valve assembly embodiment. The elevated head reduces the available volume for tank discharge yet realizes improved discharge performance through a discharge outlet. This is accomplished even though discharge outlets of identical parameters are used with conventional flush valve assemblies. As seen in FIG. 7, conventional flush assembly (1) has a valve body with a blunt-edge valve inlet configuration. This valve inlet is provided in combination with a valve body lumen having an inside diameter equal to that of the discharge outlet. Consequently, the flush valve uses a maximum discharge water volume C to generate power only along the effective diameter (thereby incurring significant power losses). Conventional flush valve assembly (2) has a radiused valve inlet configuration to promote tank discharge throughout the discharge outlet diameter; the effective head, however, is less than or equal to that of valve (1) and the maximum discharge water volume B remains high.

Referring further to FIG. 7, the current invention combines a radiused valve inlet configuration with an elevated valve body wall such that the effective head is approximately equal to that used in the conventional flush valves (wherein radius RI is desirably from about 0.75" to about 1"). This has the advantage of reducing the available maximum discharge water volume A, yet realizing superior water discharge that employs the entire discharge outlet diameter. The valve body wall further realizes a slight tapering along a profile thereof such that the inner diameter thereof gradually decreases (inuring to the benefit of powerful water discharge).

Figure 8:
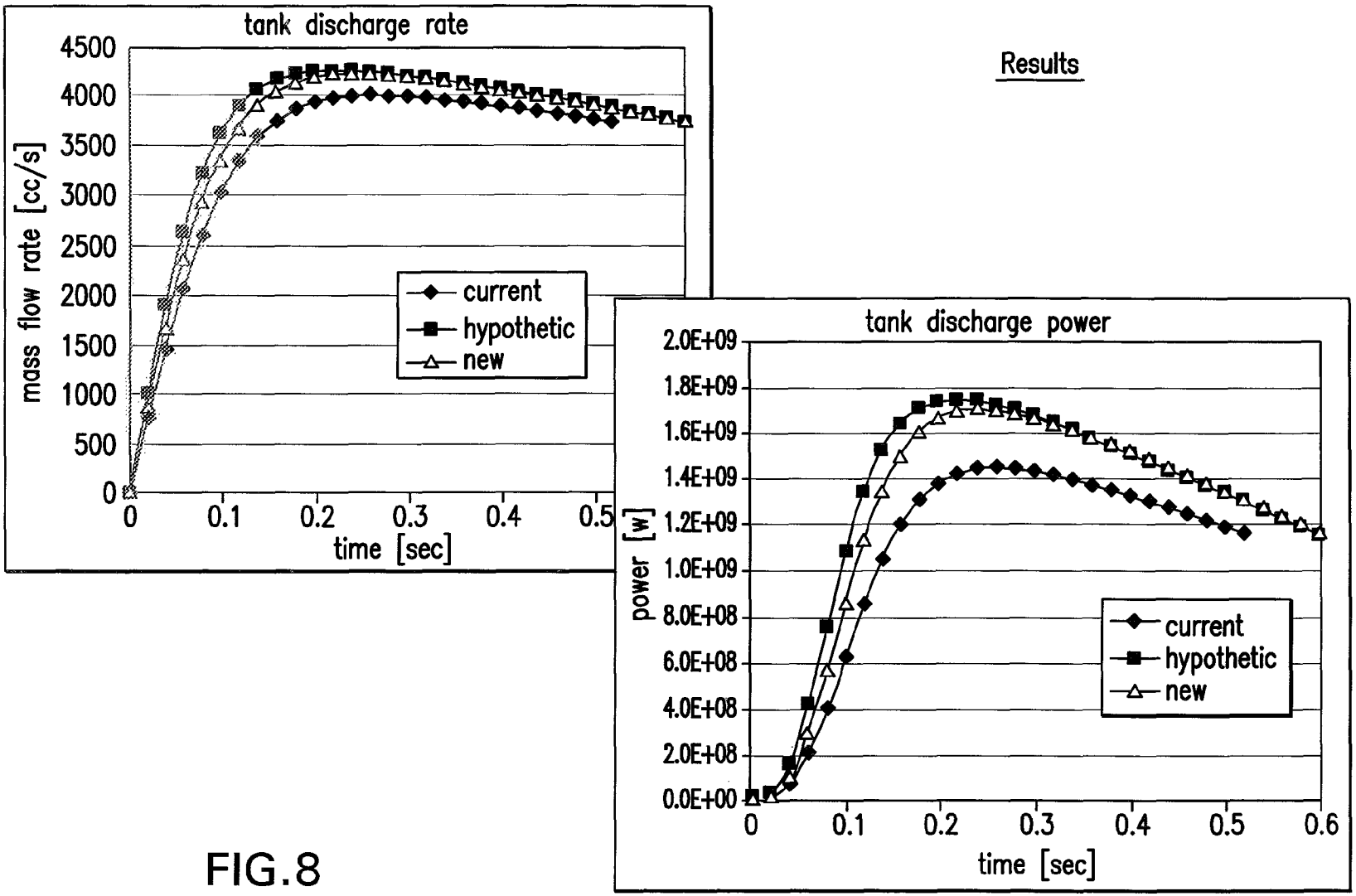
FIG. 8 shows graphs of the tank discharge rate and the tank discharge power realized with the flush valve assembly of the present invention.

The performance characteristics of the present invention flush valve assembly are illustrated in FIG. 8, wherein the tank discharge rate and the tank discharge power of the present invention flush valve assembly is compared with that of Applicant's current flush valve configuration (disclosed by Applicant's co-owned U.S. Pat. Nos. 6,901,610, 6,728,975 and 6,715,162, referenced hereinabove) and a conventional flush valve having desired discharge characteristics. It is noted that the present invention flush valve achieves a maximum mass flow rate of about 4200 cc/sec and maximum power of about 1.7E+09 W in less than 0.3 seconds. This enhanced performance is achieved with fewer total parts and only a single moving element as compared with applicant's current flush valve. Thus, reduction in temporal and fiscal costs associated with manufacturing, installation and maintenance of such flush valves is realized without attenuation of valve performance.

Various changes to the foregoing described and shown structures are now evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A flush valve assembly for a toilet water tank, wherein said water tank stores water for delivery to a toilet bowl in fluid communication therewith, said flush valve assembly comprising:

a body subassembly comprising a valve body having a proximate extent with a radiused inlet defined thereabout, a distal extent having an elevated base, and a coextensive wall therebetween;

a poppet valve subassembly comprising a buoyant float means being coaxially and reciprocatingly mounted with respect to said valve body so as to create a valve opening therebetween when said float means is elevated relative to said valve body;

said poppet valve subassembly being reciprocable between a first rest position, wherein said float means is sealingly seated proximate said radiused inlet of said valve body to obstruct fluid flow through said valve opening, and a second open position, wherein said float means is elevated relative to said radiused inlet; and guide means comprising a guide member in operative communication with said float means and alignment means to accommodate reciprocable movement of said guide member relative to said valve body, said alignment means inhibiting deviation of said guide member from a predetermined axial guide path when said float means moves between said first position and said second position, wherein said body subassembly further includes a valve bracket having an orifice to accommodate seating of said elevated base relative to said water tank.

2. The flush valve assembly according to claim 1, wherein said valve bracket includes at least one protuberance with at least one aperture defined therethrough, said at least one aperture accommodating securable insertion of at least a portion of a corresponding fastener thereby.

3. The flush valve assembly of claim 1, wherein said guide member comprises an elongate guide rod of predetermined length and having a longitudinal axis defined therethrough, said axis being coincident with said axial flow path to properly guide and accurately align said float means with said valve body when said float means moves between said first position and said second position.

4. The flush valve assembly of claim 3, wherein said guide rod is coupled to at least one of said upper float cover and said bottom float cover.

5. The flush valve assembly of claim 4, wherein said coupling is effected by one of threaded engagement, frictional engagement, snap-fit engagement, clutching engagement, epoxy and any combination and any equivalent thereof.

6. The flush valve assembly of claim 1, wherein said sealing means comprises an annular seal of predetermined diameter.

7. The flush valve assembly of claim 6, wherein said annular seal has an outer diameter from about 3.5" to about 4.3".

8. The flush valve assembly of claim 1, wherein said valve body further comprises a valve body wall having an inner peripheral surface that defines a region through which flush water travels during a flush cycle and an opposed outer peripheral surface.

9. The flush valve assembly of claim 8, wherein a connection means is provided along said outer peripheral surface.

10. The flush valve assembly of claim 9, wherein said connection means accommodates an overflow means disposed thereat or thereadjacent so as to establish fluid communication between said toilet tank and said flush valve assembly.

11. The flush valve assembly of claim 1, wherein said elevated base accommodates detachable fastening of said flush valve assembly with said water tank.

12. The flush valve assembly of claim 11, wherein detachable fastening of said flush valve assembly is effected by one or more threads disposed on at least one of said elevated base and a corresponding fastening member disposed at or adjacent said water tank.

13. The flush valve assembly of claim 1, wherein said radiused inlet desirably assumes an inner diameter from about 3.0" to about 3.5" and an outer diameter from about 4" to about 5".

14. The flush valve assembly of claim 1, wherein said alignment means comprises at least one wing extending from said inner peripheral surface of said valve body, said at least one wing having a guide extent defined thereon.

15. The flush assembly of claim 14, wherein said guide extent is disposed at a distalmost extent of said at least one wing relative to said inner peripheral surface of said valve body.

16. The flush valve assembly of claim 14, wherein said at least one wing defines a guide space thereby that accommodates reciprocable movement of said guide member.

17. The flush valve assembly of claim 1, wherein said flush valve assembly is in operable communication with a flush actuation means.

18. The flush valve assembly of claim 17, wherein said flush actuation means comprises a flush lever displaceable by a user between a first rest position, corresponding to said first position of said float means, and a second position, corresponding to said second position of said float means.

* * * * *